United States Patent [19]

Wosniewski

[11] 4,080,604

[45] Mar. 21, 1978

[54] MEANS FOR TUNING A LOADED COIL ANTENNA

[75] Inventor: Thomas M. Wosniewski, Mason City, Iowa

[73] Assignee: Robyn International, Inc., Rockford, Mich.

[21] Appl. No.: 725,183

[22] Filed: Sep. 21, 1976

[51] Int. Cl.[2] ..... H01Q 9/00

[52] U.S. Cl. ..... 343/750; 343/745; 343/861

[58] Field of Search ..... 343/752, 750, 749, 746, 343/745, 747, 861

[56] References Cited

U.S. PATENT DOCUMENTS

| | | | |
|---|---|---|---|
| 3,064,257 | 11/1962 | Guest | 343/747 |
| 3,474,453 | 10/1969 | Ireland | 343/745 |
| 3,798,654 | 3/1974 | Martino et al. | 343/750 |

*Primary Examiner*—Eli Lieberman

*Assistant Examiner*—David K. Moore

*Attorney, Agent, or Firm*—Blanchard, Flynn, Thiel, Boutell & Tanis

[57] ABSTRACT

A loading coil connects between an antenna and ground and has an intermediate feed point. A conductive member opposes at least several turns of the loading coil and is disposed in distributed capacitive relationship therewith. The conductive member and coil are separated by a dielectric member. The conductive member is preferably movable with respect to the coil to change the resonant frequency of the antenna and may be a conductive ring or disk axially shiftable with respect to the coil or a vane pivotable with respect to such coil. In one embodiment, the conductive member is fixed and the dielectric member, having a dielectric constant different from air, is shiftable to change the distributed capacitance of the conductive member and coil and hence the resonant frequency of the antenna apparatus.

7 Claims, 9 Drawing Figures

MEANS FOR TUNING A LOADED COIL ANTENNA

FIELD OF THE INVENTION

This invention relates to a tunable radio antenna apparatus and more particularly relates to such an apparatus having a taped loading coil for impedance matching to a coaxial feed line.

BACKGROUND OF THE INVENTION

Antenna radiating elements can be properly matched to the feedline by using a taped loading coil at the feed point of the coaxial feedline. This technique is popular when matching a coaxial feedline to a vertical whip or Marconi type antenna using a ground plane or a vehicle body for the grounded side of the antenna system.

Prior attempts to tune such an antenna to a specific frequency have, insofar as is known, primarily used the following methods, which have been less than entirely satisfactory for various reasons. One prior approach involves connection of a variable capacitor between the antenna radiating element (beyond the loading coil from which the radiating element extends) and ground, commonly a vehicle body. The variable capacitor is then varied by rotating its shaft to tune the antenna. This is a parallel resonance tuned circuit. A disadvantage is that the tuning capacitor requires a weather-proof container to prevent moisture from shorting out its plates and prevent oxidation from degrading the usual rotor connection to ground.

A prior variation has been to couple the ground end of the loading coil through a variable capacitor to the ground plane, or vehicle body. Tuning is then accomplished by rotating the shaft of the variable capacitor. This is a series resonant tuned circuit. This approach also has the disadvantage of requiring a weather-proof container for the variable capacitor to prevent shorting and oxidation as above-mentioned. In addition, the tuning of the series resonant circuit also, and undesirably, affects the impedence match between the coaxial feedline and the antenna.

Prior known attempts to employ capacitive means for antenna tuning, aside from ones of the problems above-outlined, have often also suffered from excessive mechanical complexity and escessive cost, as well as difficulties in adjusting capacitive elements, particularly by hand, when the antenna is radiating power.

Another approach to tuning has been by dematching the antenna and its feedline, such as by moving the feed point on the coil or changing the length of a coil with a shorting device. However, mismatch tuning is an inefficient power radiation technique that often results in radiation of spurious undesirable signals.

A further approach to tuning has been by varying the length of the antenna element above the loading coil. However, the usual means for varying the length of the antenna element grounds out the antenna during tuning and, when the antenna is radiating power, it therefore cannot be tuned. Tuning then becomes a trial-and-error sequence which is both time consuming and potentially inaccurate, involving within each trial-and-error, turning power off and on for adjustment and checking respectively.

Accordingly, the objects and purposes of this invention include provision of:

A tunable loading apparatus particularly for a vertical antenna with an off-center fed base loading coil.

An apparatus, as aforesaid, suitable for Citizens Band and the like communication use and which, for example, permits an antenna to be matched to a 50 ohm coaxial feedline by the position of the feed point on the base loading coil and the antenna to be tuned to the desired specific frequency by manually adjusting a capacitance distributed with respect to the loading coil up and down over the radiating portion of such loading coil.

An apparatus, as aforesaid, permitting adjustment of such distributed capacitance manually and without turning off transmitter power while tuning the antenna, particularly where a relatively low power transmitter, such as a Citizens Band transceiver feeds the antenna, wherein mismatch does not appear as long as tuning is accomplished over a relatively narrow frequency range, wherein weather-proof containers are not required and corrosion does not affect reliable and continued connection or grounding, and further wherein the apparatus is substantially nonaffected by vibration, as in use on automotive vehicles.

An apparatus, as aforesaid, which is simple in construction and to use and can be produced at low cost.

Other objects and purposes of this invention will be apparent to persons acquainted with apparatus of this general type upon reading the following specification and inspecting the accompanying drawings.

SUMMARY OF THE INVENTION

Figure 1:
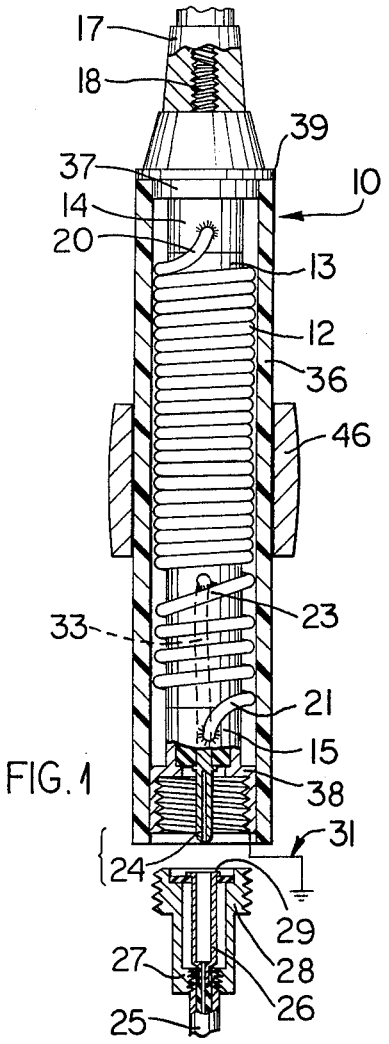
FIG. 1 is a fragmentary elevational view of an embodiment of the invention partially broken to show the off-center fed loading coil.
Figure 2:
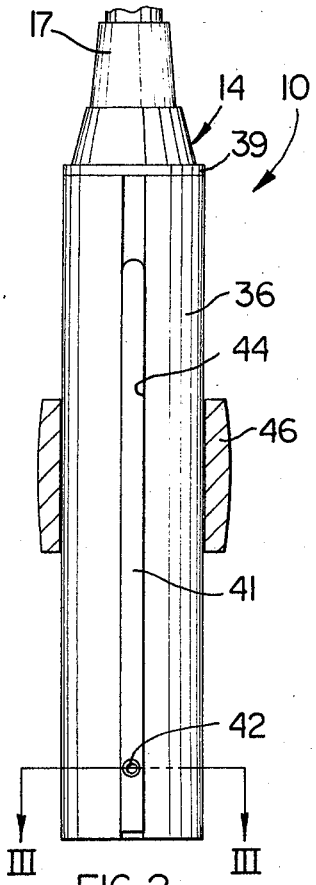
FIG. 2 is an elevational view similar to FIG. 1 but with the insulating sleeve and ground strip shown.

The objects and purposes of the invention are met by providing an off-center fed loading coil which matches the impedence of a Marconi type antenna, for the band width of the latter, and a feedline, by taping the center conductor of the feedline on the loading coil, between the ground and radiator connected ends of such coil and below the electrical center of such coil. The loading coil is covered by an electrically insulating sleeve and a grounding strip runs on the outside of the insulating sleeve and is electrically connected to the ground end of the loading coil. In a preferred embodiment, a removable electrically conductive ring electrically engages the grounding strip and surrounds the sleeve and strip for axial adjustment with respect thereto whereby to change the resonant frequency of the apparatus. In further embodiments, the ring is replaced by an axially shiftable annular disk or a movable platelike member, in each instance grounded. In a further embodiment the ring is replaced by the fixed conductive member at at least a portion of the dielectric material between the conductor member and coil is movable to change the dielectric constant of the distributed capacitive coupling between the conductive member and coil.

DETAILED DESCRIPTION

FIGS. 1–5 disclose an antenna apparatus 10 embodying the invention, for example a Citizens Band antenna apparatus.

The apparatus 10 supports an axially elongate, wound loading coil 12 on an insulative rod 13. Upper and lower electrically conductive ferrules 14 and 15 fixedly connected in coaxial fashion to the respective upper and lower ends of the insulative rod 13 and such fixed connection may be in any conventional manner not shown. A conductive antenna member, or whip, 17 is electrically and fixedly connected to the upper portion of ferrule 14 in any conventional manner, such as by threaded engagement on an upward extension of the ferrule as at 18. If desired, the whip 17 may have a conventional coil spring type lower end, not shown, to connect to the ferrule 14.

The upper and lower ends 20 and 21, respectively, of the loading coil 12 (FIG. 1) are brought axially beyond the insulative rod 13 and fixed as by soldering to the adjacent surface of the conductive ferrules 14 and 15, respectively. Accordingly, the upper end 20 of the loading coil 12 connects electrically to the lower end of antenna whip 17. The lower end 21 of the loading coil connects through the ferrule 15 to ground, as represented by the antenna ground plane or the body of a vehicle in the case of a mobile antenna assembly, and in any conventional manner not shown.

Below its electrical center, as indicated in FIG. 1, the loading coil 12 is provided with a tap 23. A feedline 25 extends to the antenna assembly 10 from a conventional transmitter or transceiver (e.g. a Citizens Band transceiver) not shown. Typically, and as here shown, the feedline 25 is a coaxial line. The center conductor 26 of the coaxial feedline 25 is electrically connected to the tap 23 of the loading coil 12, while the ground sheath or conductor 27 of the feedline 25 is electrically connected to the lower ferrule 15. In this manner, the ferrule 15 is connected to the ground side of the transmitter or transceiver. Where the antenna apparatus is supported on a vehicle body, and the latter is used as a ground plane for the antenna, the ferrule 15 is preferably grounded to the adjacent metal vehicle body in any conventional manner as at 31.

The feedline conductors 26 and 27 may be led to and physically fixed to ferrule 15 and the loading coil 23, respectively, in any convenient manner. For example, in the preferred embodiment shown, the ferrule 15 and at least the lower portion of the insulative rod 13 are hollow. A spool-like insulative portion 22 fixed in the hollow ferrule 15 insulatively supports a coaxial conductive pin 24 which extends downward loosely into the internally threaded, socketlike lower end of the ferrule. A wire 33 is connected (e.g. by soldering) to the pin 24, is insulated from the ferrule 15, extends up the hollow insulative rod, and emerges radially through an opening in the hollow rod 13 to connect, as by soldering, to the tap 23 on the coil 12. Thus, by connecting the ground sheath 27 and central conductor 26 of the infeed cable 25 to the threaded outer part 28 and insulatively mounted socket 29 of the complimentary conventional connector 30, the cable is readily connectible to the antenna apparatus.

Immediately surrounding, and coaxially telescoped over, the loading coil 12 is an insulating sleeve 36 of cylindrical shape. Preferably, the ferrules 14 and 15 are provided with enlarged diameter portions 37 and 38 respectively outboard of their inner ends and which equal or preferably slightly exceed the loading coil diameter to support the insulating sleeve 36 at its opposite end. The insulating sleeve 36 is preferably fixed by any convenient means, such as a press-fit or adhesive, to the enlarged portions 37 and 38 of the ferrules. Preferably, the upper ferrule includes a radial flange 39 overlying the upper end of the insulating sleeve 36 in weathertight fashion. The insulating sleeve 36 serves, among other purposes hereafter apparent, to protect the coil and its connections from mechanical damage and weather degradation.

A conductive ground strip 41 (FIGS. 2 and 3) is fixed to and extends axially along the outer surface of the insulating sleeve 36, substantially from the lower end thereof to a location somewhat spaced from the ferrule flange 39. The lower end of the ground strip 41 radially overlies the lower ferrule 15 and electrically connects thereto by means of a conductive screw 42, or the like, which extends through the lower end of the ground strip 41, a suitable opening in the insulative sleeve 36 and into threaded engagement with an opening 43 in the conductive grounded lower ferrule 15. Accordingly, the ground strip 41 is grounded along with the ferrule 15. For increased mounting security, the ground strip 41 may be partly recessed in a suitable axial groove 44 in the peripheral surface of insulating sleeve 36 and, in addition to the screw 42, means such as a suitable adhesive or the like may be used in fixing the ground strip to the insulating sleeve. The strip 41 and sleeve 36 together form a constant cross section over most of the length of the sleeve 36.

A conductive ring 46 (FIGS. 4 and 5) snugly surrounds the strip 41 and insulating sleeve 36 and is of axial extent sufficient to overlie at least several turns, at one time, of the loading coil 12. The conductive ring is in electrical contact with and hence is grounded by the grounding strip 41.

Figure 4:
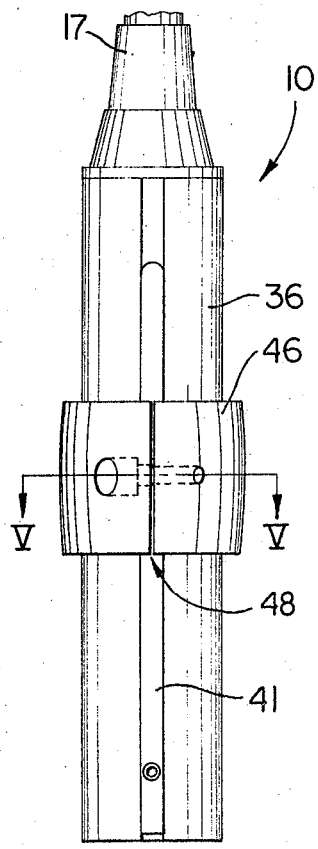
FIG. 4 is an elevational view similar to FIG. 1 but with the ring element unbroken.
Figure 3:
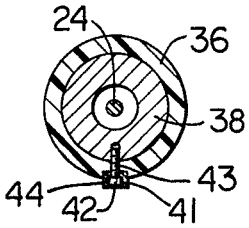
FIG. 3 is a sectional view substantially taken on the line III—III of FIG. 2.
Figure 5:
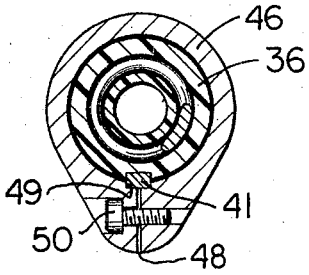
FIG. 5 is a sectional view substantially taken on the line V—V of FIG. 4.
Figure 6:
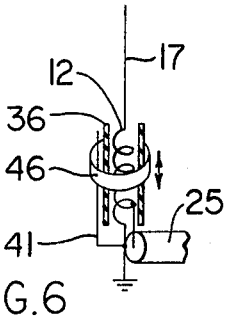
FIG. 6 is a schematic view of the embodiment of FIGS. 1–5.

More particularly, the ring 46 is preferably formed as a split ring (as seen in FIGS. 4 and 5) and is also provided with an axial groove to accommodate the radially outwardly extending part of the ground strip 41. Conveniently, the split portion 48 of the ring 46 extends through the central portion of the mentioned groove, indicated at 49, and the split portion of the ring is sufficiently radially extended as to be able to accommodate a transverse screw 50 therethrough, with its head engaging one end of the split ring and the other end threadedly engaging the other end of the split ring. Accordingly, tightening of the screw 50 causes the ring 46 to sufficiently snugly grip the insulator sleeve 36 as to maintain the axial position of the ring 46 thereon, and to enhance the electrical surface contact between the strip 41 and the ring 46. On the other hand, by sufficiently loosening the screw 50, the ring 46 may be axially adjusted upward or downward along the insulating sleeve 36 and hence change the particular turns of the loading coil which is radially overlaps. Thus, the ring 46 may normally be positioned along the length of loading coil 12 and fixed at its desired point of adjustment.

OPERATION

To tune the antenna assembly 10, a conventional field strength meter, SWR meter, or neon indicator can be arranged and used in a conventional manner to indicate when the antenna has been tuned to proper resonant frequency. Tuning, in the embodiment of FIGS. 1–5, is accomplished by loosening the screw 50 and axially shifting the grounded conductive ring 46 along the sleeve 36, such that it overlies different portions of the loading coil 12. The conductive ring 46, grounded by ground strip 41 and ferrule 15, forms a distributive capacitance between ground and several turns of the loading coil 12 at any given time, the several turns being those radially overlayed by the ring 46.

In more detail, the invention involves, in this embodiment, an unsymmetrical system of a grounded antenna, wherein a quarter-wave (for example) antenna is shortened by a base loading coil. The antenna is matched to the low impedence coaxial feedline by direct connection above ground at the impedence point for a desired frequency. To match the antenna then requires shortening it to the high frequency side of resonance so that it shows a particular value of capacitive reactance at its base. The antenna terminals are then shunted by an inductive reactance, the grounded side of the loading coil. The conductive and concentric ring, which is grounded, then applies a distributive capacitance to the turns of the coil that fall within the capacity field of such concentric turning ring 46. Thus, the capacitance to ground of the various turns under the ring 46 transforms the radiation resistance to a parallel equivalent circuit. The effect of this reactive load on the feedline is to shift the phase of the current with respect to the voltage, both in the load itself, and in the reflected components of the voltage and current. This in turn causes a shift in the phase of the resultant voltage. The net result is to shift the points along the line at which the various effects of impedence will occur. When the load is inductive acting, the point of maximum voltage and minimum current is shifted toward the loading coil. When the load is capacitive acting, the point of maximum current and minimum voltage is shifted toward the loading coil. It is the function of the concentric ring 46 to adjust this reactance between the inductive acting and capacitive acting phenonenon.

Important to note is that when the antenna apparatus is properly grounded, a person, though himself grounded, may grip the ring 46 by hand and manually move same up and down along the sleeve 36 while the transmitter is on, without harmful effects to such person. This is not true under all conditions. Moreover, the close presence of a person's hand or fingers to the ring 46 does not materially affect the tuned frequency of the apparatus 10. Particularly because the transmitter need not be truned on and off every time the ring 46 is to be adjusted, meter or indicator readings may be taken continuously, even as the ring 46 is adjusted up and down, such that the best location for the ring 46 may be quickly and easily found and the ring then fixed thereat by tightening of screw 50. Accordingly, the antenna assembly 10 may be quickly and easily tuned, in a most convenient manner, when the transmitter is switched from channel to channel, for maximum transmission efficiency.

MODIFICATIONS

While a preferred embodiment has been described in detail above, it will be understood that modifications and variations of the invention are contemplated and among these are several disclosed in schematic form in FIGS. 6–9. In particular, FIG. 6 simply schematically discloses the embodiment already above discussed with respect to FIGS. 1–5.

Figure 7:
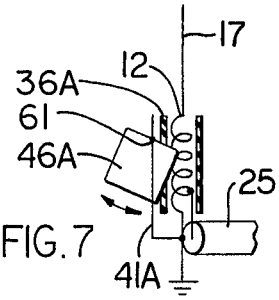
FIG. 7 is a schematic view of a modification of the FIGS. 1–5 embodiment.
Figure 8:
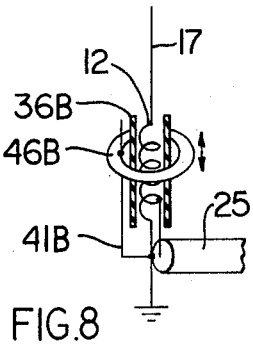
FIG. 8 is a schematic view of a further modification.

The FIG. 8 modification differs primarily by use of a flat, annular disk 46B as the axially shiftable conductive member which provides the adjustable distributive capacitance to ground with respect to the loading coil 12. The annular disk 46B is again maintained insulated from the coil 12 as indicated at 36B. In FIG. 7, the axially shiftable ring 46 is replaced by a platelike conductor 46A which may be pivoted, as indicated generally at 61 with respect to the ground connector 41A. In this instance, the platelike member, or vane, 46A varies the ground to loading coil capacitance by moving toward or away from the loading coil 12.

Figure 9:
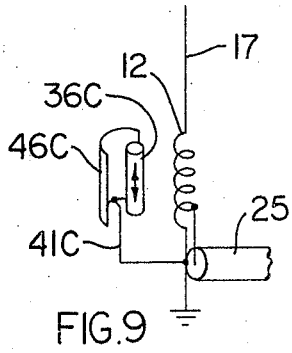
FIG. 9 is a schematic view of a still further modification.

The FIG. 9 modification departs from those above in that the adjustable ring 46 is replaced by a fixed conductor 46C, which may be fixedly, as well as electrically, secured to the ground strip 41C. Also, at least a portion of the space between the conductor 46C and the coil 12 is occupied by a dielectric member 36C, having a dielectric constant different from air, and which may be supported, as convenient, with respect to the conductor 46C and coil 12 for adjustive movement therebetween. Hence, more or less of the member 36C is interposed between the grounded conductor 46C and a given portion of the coil 12, so as to change the resonant frequency of the system.

Although particular embodiments of the invention have been disclosed for illustrative purposes, it will be recognized that variations or modifications of the disclosed apparatus, including the rearrangements of parts, will be within the scope of the present invention.

The embodiments of the invention in which an exclusive property or privilege is claimed are defined as follows:

1. A tunable antenna loading apparatus, comprising:

a loading coil having an antenna connection means adjacent one end thereof and a ground connection means adjacent the other end thereof and a feed connection means intermediate said antenna connection means and ground connection means, said loading coil being fixedly supported with respect to said antenna connection means and ground connection means, said loading coil comprising a multiple turn conductor;

a conductive member close spaced from said coil and having at least a portion arranged to face at least a portion of said coil, such that said conductive member and said coil simulate the opposed plates of a capacitor, said conductive member being electrically connected to said ground connecting means;

dielectric means interposed between said coil and conductive member to act as a dielectric of a capacitor, said conductive member being adjustably movable with respect to said coil to vary the distributive capacitance supplied by the relationship of said coil and conductive member and with the inductance of said coil to adjust the resonant frequency of the antenna apparatus;

a conductive ground strip electrically conneced to said ground connecting means adjacent said other end of said coil and extending lengthwise along said coil toward said one coil end and being electrically insulated from said coil by said dielectric means, said conductive member being in electrical contact with said ground strip, said conductive member comprising a conductive vane pivotally fixed on said ground strip in radial opposition to said coil for pivotal movement into and out of capacitance relation with sets of turns of said coil.

2. A tunable antenna loading apparatus, comprising:

a loading coil having an antenna connection means adjacent one end thereof and a ground connection means adjacent the other end thereof and a feed connection means intermediate said antenna connection means and ground connection means, said loading coil being fixedly supported with respect to said antenna connection means and ground connection means, said loading coil comprising a multiple turn conductor;

a conductive member close spaced from said coil and having at least a portion arranged to face at least a portion of said coil, such that said conductive member and said coil simulate the opposed plates of a capacitor, said conductive member being electrically connected to said ground connecting means;

dielectric means interposed between said coil and conductive member to act as a dielectric of a capacitor, said dielectric means being adjustably movable with respect to said coil to vary the distributive capacitance supplied by the relationship of said coil and conductive member and with the inductance of said coil to adjust the resonant frequency of the antenna apparatus;

a conductive ground strip electrically connected to said ground connecting means adjacent said other end of said coil and extending lengthwise along said coil toward said one coil end and being electrically insulated from said coil by said dielectric means, said conductive member being in electrical contact with said ground strip, in which said conductive member is fixed with respect to said coil and extends lengthwise thereof in close spaced relation thereto, said dielectric means comprising a dielectric member having a dielectric constant different than that of air and disposed for axially adjustable movement between said conductive member and said coil.

3. A tunable antenna loading apparatus, comprising:

an elongate, multiple turn loading coil having an antenna connection adjacent its upper end and a ground connection adjacent its lower end, the upper and lower parts of the coil joining at a feed connection spaced intermediate said antenna connection and ground connection;

an elongate insulating sleeve extending substantially the length of said coil and snugly housing the coil therein, said ground and antenna connections being at the top and bottom of said insulating sleeve;

a conductive ring axially shorter than said upper coil part and axially slidably engaged by said insulating sleeve, said conductive ring having a range of axial positions in which it radially overlies only a fraction of the turns of said upper part of said coil and yet does not extend upward beyond said antenna connection and downward beyond said feed connection, permitting said ring to capacitively couple to but a few turns of the coil even when at the upper end of the coil;

a circumferentially thin, conductive ground strip fixed axially on said insulative sleeve and connected to the ground connection at the base of said sleeve and extending substantially to the top of said coil, the major circumference of said coil below said ring being free of conductive shielding, said narrow strip being slidably engaged by said ring to ground said ring to said ground connection.

4. The apparatus of claim 3 in which said conductive ring is split and including tightenable means spanning said split and actuable for tightening and loosening said ring to correspondingly fix and permit axial adjustment thereof on said insulating sleeve, said conductive ground strip projecting radially from the surface of said insulating sleeve at the split in said ring, said ring having an axially extending recess in its inner face at the radially inner edge of said split, said recess being sized to receive the projecting portion of said conductive strip therein, such that tightening of said tightenable means causes said ring to grip both mechanically and electrically said ground strip, whereas releasing of said tightenable means permits raising and lowering of said ring on said insulating sleeve for varying the resonant frequency of said antenna apparatus by changing the turns of the coil to which said ring is capacitively coupled.

5. The apparatus of claim 4 in which said insulating sleeve has an axially extending groove in its periphery, said conductive ground strip being fixed in and extending along said groove, such that the radially inner part of said strip lies in said insulating sleeve groove and the radially outer part of said strip has a part of its length received in said conductive ring recess to circumferentially locate said conductive ring on said insulating sleeve.

6. The apparatus of claim 5 including an insulating rod on which the coil is wound, said antenna connection and ground connection comprising conductive ferrules fixed to the upper and lower ends of said insulating rod and electrically connected to the adjacent upper and lower ends, respectively, of said coil, said insulating sleeve containing said insulating rod and coil, and having its ends plugged by said ferrules, the upper end of said upper ferrule constituting an antenna support and electrical connection, and including a conductive member extending radially through the lower portion of said insulating sleeve to conductively connect said strip to said lower ferrule through the intervening thickness of said insulating sleeve.

7. The apparatus of claim 3 in which said ring is wider radially than axially so as to have a disk-like form.

* * * * *